US005951784A

United States Patent [19]

Hawes

[11] Patent Number: 5,951,784

[45] Date of Patent: Sep. 14, 1999

[54] CONCRETE CLEANER AND METHOD FOR CLEANING CONCRETE

[75] Inventor: Charles Hawes, San Antonio, Tex.

[73] Assignee: Armor All Products Corporation, Aliso Viejo, Calif.

[21] Appl. No.: 08/878,828

[22] Filed: Jun. 19, 1997

[51] Int. Cl.[6] ..... C11D 3/075; C11D 1/22; B08B 3/08

[52] U.S. Cl. ..... 134/40; 134/2; 510/365; 510/421; 510/422; 510/214; 510/215

[58] Field of Search ..... 510/365, 421, 510/422, 417, 214, 215; 134/40, 3, 2

[56] References Cited

U.S. PATENT DOCUMENTS

| | | | |
|---|---|---|---|
| 4,749,508 | 6/1988 | Cockrell, Jr. et al. . | |
| 4,877,459 | 10/1989 | Cockrell, Jr. et al. . | |
| 4,877,691 | 10/1989 | Cockrell, Jr. et al. . | |
| 5,137,793 | 8/1992 | Cockrell, Jr. et al. . | |
| 5,158,612 | 10/1992 | Savoly et al. | 106/678 |
| 5,342,450 | 8/1994 | Cockrell, Jr. et al. | 134/3 |
| 5,656,683 | 8/1997 | Ruggiero et al. | 524/100 |

FOREIGN PATENT DOCUMENTS

WO 96/16132 5/1996 WIPO .

OTHER PUBLICATIONS

McCutcheon's vol. 1 Emulsifiers and Detergents 1997, McCutcheon's Division, MC Publishing, Glen Rock, NJ, 1997.

*Primary Examiner*—Yogendra Gupta
*Assistant Examiner*—Gregory E. Webb
*Attorney, Agent, or Firm*—Burns, Doane, Swecker & Mathis, L.L.P.

[57] ABSTRACT

A hazardous ingredient free cleaning composition and method for cleaning an oil/grease stained concrete surface. The cleaning composition includes (i) about 50 to about 95% by weight of water; (ii) at least about 2% by weight of a detergent builder; (iii) at least about 1% of a surfactant; and (iv) at least about 1% of a coupling agent which minimizes phase separation of the surfactant from the builder during cleaning of the surface. The method includes applying the cleaning composition to the stained surface, allowing the composition to set on the surface, and rinsing the surface with water.

6 Claims, 1 Drawing Sheet

CONCRETE CLEANER AND METHOD FOR CLEANING CONCRETE

FIELD OF THE INVENTION

The present invention relates to a hazardous ingredient free composition and a related method for cleaning automotive oils and grease stains from concrete.

BACKGROUND OF THE INVENTION

Current methods for cleaning automotive oil and grease stains from concrete typically require scrubbing with a broom using a cleaning formula containing hazardous ingredients. The various formulations on the market which are effective are often hazardous because they contain harsh solvents, acids, or caustic substances which can become more hazardous when concentrated as a result of drying. These hazardous substances, used in combination with other ingredients, are effective in removing automotive oil and grease stains on concrete but also are inherently hazardous to people, pets and plants. They can also cause damage to the concrete itself when used regularly. Usually a strong mineral acid such as hydrochloric or hydrofluoric acid is responsible for concrete damage or spalling of the surface. The present invention, therefore, seeks to overcome these and other drawbacks.

SUMMARY OF THE INVENTION

A first object of the invention is to provide a composition for cleaning concrete or similar surfaces.

Another object of the invention is to provide a composition for cleaning concrete or similar surfaces that does not contain harsh solvents, acids, or caustic substances.

Yet another object of the invention is to provide a composition for cleaning concrete or similar surfaces that minimizes hazardous risk to humans and pets.

Still another object of the invention is to provide a composition for cleaning concrete or similar surfaces without damaging the concrete or other similar surface.

A further object of the invention is to provide a method for cleaning concrete or similar surfaces which is particularly effective in removing stains from automotive oils and grease.

Another object of the invention is to provide a method for cleaning concrete or similar surfaces with the composition of the present invention.

In a first aspect, the present invention relates to an aqueous cleaning composition for cleaning an oil stained surface like concrete comprising (i) about 50 to about 95% by weight of water; (ii) at least about 2% by weight of a detergent builder; (iii) at least about 1% of a surfactant; and (iv) at least about 1% of a coupling agent which minimizes phase separation of the surfactant from the builder during cleaning of the surface.

In a second aspect, the cleaning composition of the present invention can optionally include a corrosion inhibitor.

In a third aspect, the present invention provides a method for cleaning concrete or a similar surface comprising applying the composition of the invention to the surface; allowing the composition to set on the surface; and rinsing the surface with water.

DETAILED DESCRIPTION OF PREFERRED EMBODIMENTS

Figure 1:
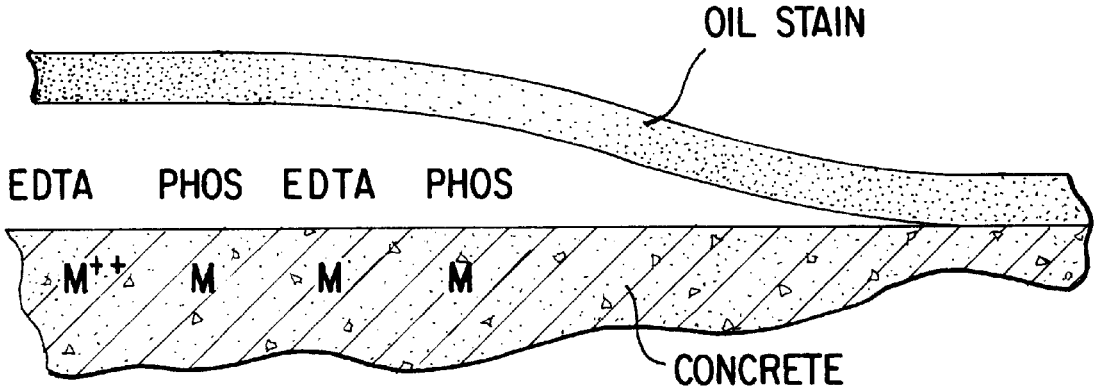
FIG. 1 illustrates the theorized bonding between the components of the cleaning composition of the invention and metals present in the concrete surface to be cleaned wherein M represents the metals, PHOS represents phosphate, and EDTA represents ethylenediaminetetraacetate tetrasodium salt.

The invention provides a cleaning composition which is effective for cleaning oil stained concrete surfaces. The composition is a hazardous ingredient free aqueous cleaning composition including at least about 50% water, at least 4% of a detergent builder, at least about 1% of a surfactant and at least about 1% of a coupling agent which minimizes phase separation of the surfactant from the builder during cleaning of the surface. This cleaning composition overcomes disadvantages of prior art cleaners which undergo "breaking" during which the surfactant separates from the builder and floats on the surface thus preventing the builder from contacting the surface to be cleaned. According to the invention, the coupling agent comprises a hydrotrope which carries the builder to the surface to be cleaned and allows the surfactant to break up the oil stain into fine droplets.

The cleaning composition can include at least one inorganic builder such as orthophosphates (e.g., monobasic, dibasic or tribasic phosphates including sodium or potassium salts), polyphosphates (e.g., sodium or potassium phosphates such as tripolyphosphate, pyrophosphate, pentaphosphate, hexametaphosphate, etc.), non-phosphorous alkaline sodium and potassium salts (e.g., silicates, carbonates, borates, bicarbonates, sesquicarbonates, tetraborates, etc.), or the like. A preferred phosphate builder is tetrapotassium pyrophosphate (TKPP). The foregoing ingredients can be used alone or in combination with or without additional inorganic builders.

The cleaner can include at least one organic builder such as an amino acid type builder (e.g., amino acetates or nitriloacetates such as ethylenediamine tetraacetic acid (EDTA), tetrasodium EDTA, nitrilotriacetates such as trisodium nitrilotriacetate (NTA), glycinates such as glycine, etc.), carbohydrate type builder (e.g., sugars such as succinates or gluconates, etc.), polycarboxylates (e.g., polyacrylic acid salts, citric acid, etc.), polyphophonates (e.g., Dequest 2000™ series builders available from Monsanto Co., etc.), and the like. Ethylenediamine tetraacetic acid tetrasodium salt (tetrasodium EDTA) is an especially preferred organic builder. For example, the tetrasodium salt aqueous solution sold by Dow Chemical Company under the tradename Versene 100 is an especially preferred organic builder. The foregoing organic builders can be used alone or in combination with or without additional organic builders.

The cleaner can include at least one surfactant providing wetting and optionally low foaming characteristics such as non-ionic, anionic, cationic and amphoteric surfactants. The preferred surfactants are nonionic compounds and in particular a mixture of ethoxylated alcohols has been found to be particularly effective. For example, the surfactants can comprise a mixture of alcohols sold by Shell Oil Company under the tradenames Neodol 91-6 and Neodol 91-2.5. Neodol 91-6 is a mixture of alcohols containing 9 to 11 carbon atoms with an average of 6 moles of ethylene oxide reacted onto the hydroxyl portion of the alcohols. Neodol 91-2.5 is a mixture of alcohols containing 9 to 11 carbon atoms with an average of 2.5 moles of ethylene oxide reacted onto the hydroxyl portion of the alcohols. The surfactants can be used alone or in combination. Neodol 91-6 and Neodol 91-2.5 are particularly effective when used in combination.

The cleaning composition can include a coupling agent such as an anionic coupling agent (e.g., aromatic sulfonates such as sodium xylene sulfonate, sodium alkyl napthnlene sulfonates, phosphate esters, alkyl sulfate, etc.), an amphoteric coupling agent (e.g., imidazolines, alkylamphocarboxyglycinates and alkylamphocarboxy-propionates in their mono and dicarboxylo forms, alkyl betaines, amine oxides, etc.), cationic surfactants (e.g., ethoxylates quaternary ammonium compounds, etc.), or the like. A preferred coupling agent is a hydrotrope such as sodium xylene sulfonate (SXS). A particularly preferred form of SXS is SXS-40, which is a 40% solution of SXS in water. SXS-40 is sold by Stepan Company under the tradenames STEPANATE SXS™ and similar products sold by Pilot (Pilot SXS-40) and Witco (Witconate SXS liquid, Petro BA and Petro AA). The coupling agent minimizes phase separation of the surfactant from the builder during cleaning of the surface.

The cleaning composition according to the invention may further comprise a corrosion inhibitor. A preferred corrosion inhibitor is sodium meta silicate pentahydrate ($SMS.5H_2O$), which is an aluminum corrosion inhibitor.

The cleaning composition according to one embodiment of the present invention preferably comprises 50 to 95%, preferably about 70 to 85% by weight of water; 2 to 15%, preferably about 4 to 10% by weight of a 40% solution of ethylenediaminetetraacetate tetrasodium salt in water (tetrasodium EDTA such as Versene 100) or, on a dry basis, 0.5 to 7%, preferably 2 to 5% tetrasodium EDTA; 0.5 to 10%, preferably 2 to 7%, on a dry basis, by weight of TKPP; 0.5 to 10% of at least one surfactant such as a nonionic surfactant, preferably a mixture of ethoxylated alcohol surfactants including 0.25 to 5%, preferably 0.5 to 3% by weight of a mixture of alcohols containing 9 to 11 carbon atoms with an average of 6 moles of ethylene oxide reacted into the hydroxyl portion of the alcohols (Neodol 91-6) and 0.25 to 5%, preferably 0.5 to 3% by weight of a mixture of alcohols containing 9 to 11 carbon atoms with an average of 2.5 moles of ethylene oxide reacted onto the hydroxyl portion of the alcohols (Neodol 91-2.5); and 1 to 15, preferably about 7 to 12% by weight of a coupling agent such as a 40% solution of SXS in water (SXS-40) or, on a dry basis, 1 to 10%, preferably 2 to 5% SXS. Additionally, the cleaning composition can further include a corrosion inhibitor. A specific cleaning formulation is set forth below:

6.8% Versene 100 XL 4.5% TKPP

1% Neodol 91-6

1% Neodol 91-2.5

8.5% SXS-40 bal. Water

The cleaning composition according to the present invention preferably does not contain acids, VOC's, hazardous bases such as metallic hydroxides (e.g., NaOH, KOH, etc.) or amine hydroxides (e.g., ammonium hydroxide, monoethanolamine, etc.), or other hazardous/corrosive compounds.

Doubling the strength of the above-described formula will give better visual cleaning performance on the order of a 15% increase in cleaning whereas cutting the strength of the formula in half will provide a visual performance of a 40% reduction in cleaning effectiveness.

The performance of the cleaning composition of the invention is enhanced by the combination of detergent builders and/or surfactants. The penetrating agent/surfactant aid the builder ingredients in penetrating through substances such as oil to the surface to be cleaned.

The composition of the present invention is particularly effective for removing automobile oil and grease stains from concrete and similar surfaces. Lab testing demonstrated enhanced cleaning of oil stains from concrete when a combination of an organic builder such as EDTA or NTA with an inorganic builder, especially a phosphate such as TKPP, TSP (trisodium ohosphate), or STPP (sodium tripolyphosphate), is blended with the surfactant.

It is theorized that the aqueous formulation penetrates through the oil whereby the builders come into intimate contact with the concrete surface and form chelation bonds to the metals present in the concrete surface. The chelate bonding energy overpowers the Van der Waals forces or otherwise weaker bonding between the oil and concrete. The synergistic effect between the larger EDTA molecule and smaller phosphate group could be due to a more continuous film formed where phosphate groups fill interstices or gaps between EDTA molecules. This effect is illustrated in FIG. 1. Differences in bonding energies between the builders and metals in the concrete may also play a role. Another important factor for the composition to function properly is that the solution applied to the stain must remain a clear stable formula. Premature breaking of this micro-emulsion may prevent the solution from effectively delivering the builders to the concrete interface.

The method of the invention comprises cleaning concrete or a similar surface by applying the composition of the invention to the surface, allowing the composition to set on the surface, and rinsing the surface with water.

In the method of the present invention, the composition of the invention can be applied directly to an oil or similar stain on the surface. The composition of the invention can be applied by pouring it from a container or spraying it on with a device such as a trigger sprayer, pump sprayer, or hose end sprayer.

The solution is preferably allowed to set on the stain or surface for a minimum of 15 minutes, followed by rinsing. Rinsing may be accomplished using a pressure washer, garden hose with or without an attached sprayer, or by pouring or applying water followed by vacuuming the stain with a wet vac.

Alternatively, another technique for removing the treated stain includes gently wetting the stain with water, agitating with a broom, applying an absorbent clay and sweeping the remains for disposal as a solid waste.

The cleaning composition can be in a liquid or semi-liquid form which is mixed with water and sprayed onto a stained concrete surface by a hand-held hose-end sprayer. For instance, the cleaner can be in the form of an aqueous solution which is withdrawn from a container via suction and admixed with water from a garden hose via a closed venturi or aspirator type of sprayer.

An applicator device such as a hose-end, hand-held spray gun can be used to practice the method of the invention. In such a case, it is desirable to adjust the strength of the cleaning composition to take into account the dilution ratio of the spray gun. For instance, spray guns which could be used to apply the liquid cleaning composition are disclosed in commonly owned U.S. Pat. Nos. 5,605,578; 5,595,345; and 5,567,747 and commonly owned and copending application Ser. No. 08/651,952. Such spray guns can be attached to the end of a garden hose to receive water for performing the cleaning step by combining the cleaning composition with water and spraying the mixture on a surface to be cleaned. The spray gun can also be used for performing the rinse step.

In order to further illustrate the present invention and the advantages thereof, the following specific examples are given, it being understood that such examples are intended only as illustrative and not limitative.

EXAMPLE 1

A composition as set forth below was modified by substituting different organic builders and tested for cleaning performance in removing oil stains from concrete. In terms of the cleaning result, on a scale of 0 to 5, 0 represents poor performance and 5 represents excellent performance.

| | |
|---|---|
| 77% | water |
| 6.8% | organic builder |
| 4.5% | tripotassium phosphate (TKP) |
| 1% | Neodol 91-6 |
| 1% | Neodol 91-2.5 |
| 8.5% | SXS 40 |
| 1% | KOH 45% |

| Organic Builder | Cleaning Result |
|---|---|
| NTA | 3.5 |
| Sodium Gluconate | 2.5 |
| Sodium Hydroxyacetate | 2.5 |
| Dequest 2010 | 3.0 |
| Hampshire DEG | 3.0 |
| Hampshire EDG | 3.0 |
| Sodium Acetate | 2.0 |
| Sodium Polycrylate (Goodrite) | 2.0 |
| Potassium Polyacrylate | 2.0 |
| Sodium Heptogluconate | 2.5 |
| Potassium Hydroxyacetate | 2.5 |
| tetrasodium EDTA | 3.5 |

EXAMPLE 2

A composition as set forth below was modified by substituting different inorganic builders and tested for cleaning performance in removing oil stains from outdoor concrete with 15 minute set time under sunny conditions and air temperature of 85 to 90° F. In terms of the cleaning result, on a scale of 0 to 5, 0 represents poor performance and 5 represents excellent performance.

| | |
|---|---|
| 77% | Water |
| 7% | tetrasodium EDTA (Versene 100 XL) |
| 4.5% | Inorganic builder |
| 1% | Neodol 91-2.5 |
| 1% | Neodol 91-6 |
| 8.5% | SXS-40 |
| 1% | KOH 45% |

| Inorganic Builder | Cleaning Result |
|---|---|
| TKP | 3.5 |
| TKPP | 4.0 |
| TSP | 3.5 |
| STPP | 3 |
| $Na_2CO_3$ | 2.5 |
| $K_2CO_3$ | 2.5 |
| Sodium Percarbonate | 2.5 |
| Sodium Dithionate | 2 |
| Sodium Peroxysulfate | 2 |
| KTPP | 3.5 |
| Sodium Citrate | 2.5 |
| Potassium Citrate | 2.5 |

EXAMPLE 3

A composition as set forth below was tested for cleaning performance in removing oil stains from outdoor concrete with 15 minute set time under sunny conditions and air temperature of 85 to 90° F. In terms of the cleaning result, on a scale of 0 to 5, 0 represents poor performance and 5 represents excellent performance.

| Formula | | Cleaning Result |
|---|---|---|
| 78% | Water | 3.5 |
| 7% | EDTA (Versene 100 XL) | |
| 4.5% | TKPP | |
| 1% | Neodol 91-6 | |
| 1% | Neodol 91-2.5 | |
| 8.5% | SXS-40 | |

As can be seen by comparing the KOH and TKP containing sample of Example 2 to the KOH-free and TKPP containing sample of Example 3, the hazardous ingredient free cleaning composition of the invention can surprisingly and unexpectedly achieve cleaning results (3.5) as good as the hazardous ingredient (i.e., KOH) containing composition of Example 2.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method for cleaning an oil/grease stained concrete surface comprising applying a hazardous ingredient free cleaning composition to the stained surface, the cleaning composition, comprising (i) about 50 to about 95% by weight of water; (ii) at least about 2% by weight of a detergent builder; (iii) at least about 1% of a surfactant; and (iv) at least about 1% of a coupling agent which minimizes phase separation of the surfactant from the builder during cleaning of the surface;

allowing the composition to set on the surface;

rinsing the surface with water; and applying an absorbent clay to remove the rinsed stain.

2. The method of claim 1, wherein the rinsing is carried out after the cleaning composition is allowed to set for at least 15 minutes.

3. A method for cleaning an oil/grease stained concrete surface comprising applying a hazardous ingredient free aqueous cleaning composition to the surface, the cleaning composition comprising about 50 to 95% by weight of water; about 2 to 15% by weight of a 40% solution of ethylenediaminetetraacetate tetrasodium salt in water; about 1 to 20% by weight of tetrapotassium pyrophosphate; about 0.5 to 10% by weight of a first mixture of alcohols containing 9 to 11 carbon atoms with an average of 6 moles of ethylene oxide reacted onto the hydroxyl portion of the alcohols; about 0.5 to 10% by weight of a second mixture of alcohols containing 9 to 11 carbon atoms with an average of 2.5 moles of ethylene oxide reacted onto the hydroxyl portion of the alcohols; and about 1 to 15% by weight of a 40% solution of sodium xylene sulfonate in water;

allowing the composition to set on the surface; and rinsing the surface with water.

4. The method of claim 3, wherein the rinsing is carried out after the cleaning composition is allowed to set for at least 15 minutes.

5. The method of claim 3, further comprising applying an absorbent clay to remove the rinsed stain.

6. The method of claim 3, wherein the cleaning composition further comprises about 1 to 20% by weight of sodium metasilicate.

* * * * *